US008540418B2

(12) United States Patent
Richard et al.

(10) Patent No.: US 8,540,418 B2
(45) Date of Patent: Sep. 24, 2013

(54) WEAR AND SHOCK RESISTANT ESCAPEMENT LEVER FOR A TIMEPIECE MOVEMENT

(75) Inventors: David Richard, Yverdon-les-Bains (CH); Andrés Cabezas Jurin, Yverdon-les-Bains (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 122 days.

(21) Appl. No.: 13/195,346

(22) Filed: Aug. 1, 2011

(65) Prior Publication Data

US 2012/0026845 A1 Feb. 2, 2012

(30) Foreign Application Priority Data

Jul. 30, 2010 (EP) ..... 10171477

(51) Int. Cl.
*G04B 15/00* (2006.01)

(52) U.S. Cl.
USPC ..... 368/128; 368/129

(58) Field of Classification Search
USPC ..... 368/127–132
See application file for complete search history.

(56) References Cited

U.S. PATENT DOCUMENTS

| | | | | |
|---|---|---|---|---|
| 443,363 | A | 12/1890 | Hansen | |
| 725,037 | A * | 4/1903 | Buysse | 368/127 |
| 2,124,019 | A * | 7/1938 | Wilmeth | 368/128 |
| 2,233,921 | A * | 3/1941 | Junghans | 368/127 |
| 2,717,488 | A | 9/1955 | Linard et al. | |
| 7,607,822 | B2 * | 10/2009 | Cabezas Jurin et al. | 368/127 |
| 2006/0048596 | A1 | 3/2006 | Wiederrecht | |
| 2007/0180943 | A1 | 8/2007 | Daout | |
| 2008/0101162 | A1 * | 5/2008 | Born | 368/132 |
| 2008/0259737 | A1 | 10/2008 | Jurin et al. | |
| 2010/0043578 | A1 | 2/2010 | Daout | |
| 2011/0149696 | A1 * | 6/2011 | Cettour-Baron et al. | 368/131 |
| 2011/0216629 | A1 * | 9/2011 | Zaugg et al. | 368/132 |

FOREIGN PATENT DOCUMENTS

| | | | |
|---|---|---|---|
| EP | 0 732 635 | A1 | 9/1996 |
| EP | 1 380 772 | A1 | 1/2004 |
| EP | 1 555 584 | A1 | 7/2005 |
| EP | 1 870 784 | A2 | 12/2007 |
| EP | 1 983 389 | A1 | 10/2008 |
| JP | 63-130961 | | 6/1988 |
| WO | WO 2010/063393 | A1 | 6/2010 |

OTHER PUBLICATIONS

Illustrated Professional Dictionary of Horology: fork :: webaddress fhs.ch/berner; Jan. 24, 2013.*

European Search Report issued Jan. 31, 2011, in European Application No. 10171477, filed Jul. 30, 2010.

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention concerns a escapement lever (1) for the escapement mechanism of a timepiece movement, including at least one fork delimiting a notch (2) which includes horns (3; 4) arranged for cooperating with a balance.

Said fork notch (2) includes, in at least one said horn (3; 4), a slot (5, 6) and/or a chamber (30), wherein said slot (5; 6) and/or chamber (30) is arranged to confer elasticity on the corresponding horn, which softens the shock at each impulse, by absorbing part of the impact energy, and then returning it subsequent to said impact.

23 Claims, 5 Drawing Sheets

WEAR AND SHOCK RESISTANT ESCAPEMENT LEVER FOR A TIMEPIECE MOVEMENT

This application claims priority from European Patent Application No. 10171477.2 filed Jul. 30, 2010, the entire disclosure of which is incorporated herein by reference.

FIELD OF THE INVENTION

The invention concerns an escapement lever for the escapement mechanism of a timepiece movement, including at least one fork delimiting a notch which includes horns arranged for cooperating with a balance.

The invention also concerns an escapement mechanism including an escapement lever of this type.

The invention also concerns a timepiece including at least one escapement lever of this type, and/or escapement mechanism of this type.

BACKGROUND OF THE INVENTION

The invention concerns the field of timepiece mechanisms, and more specifically the field of escapement mechanisms.

In a mechanism of this type, the escapement lever cooperates both with a balance and with an escapement wheel. On both sides, the escapement lever works with shocks, on the one hand via the fork, including horns, which cooperates with the impulse pin of the balance and on the other hand via the pallet stones which cooperate periodically with the escapement wheel. These incessant shocks generate wear, and thus over time cause deterioration of the properties of the movement. In particular, in an escapement mechanism, wear at the fork notches results in a decrease in the overall efficiency of the escapement and a drop in amplitude. The problem is therefore to reduce the wear of the escapement mechanism, particularly the escapement lever, and to make the contact zone between the escapement lever and the balance elastic, while respecting the space requirements imposed by the mechanism.

Few patent documents mention the problem of wear. The rare solutions put forward propose surface coatings, a particular choice of materials, the use of bearings, or reducing inertia by using short lever arms. The choice of particular materials or surface coatings does not reduce shocks, but delays the effect thereof. The use of ball bearings is ill-suited to a system permanently subject to shocks, and the lifetime of bearings in such mechanisms is generally reduced, which is incompatible with a timepiece. Reducing inertia is more advantageous, but it is difficult to act on an existing movement and modify its kinematics.

It will be noted in this regard that another method of reducing inertia is known from EP Patent No. 0 732 635 in the name of CSEM, through the use of silicon or similar components.

Some patent documents concern mechanical resistance, which is the closest problem to that addressed by the invention.

Thus, there is known U.S. Pat. No. 2,717,488 in the name of La Générale Horlogère relating to an escapement with a reduced noise level, which includes an escapement wheel with radial notches for damping shocks associated with the impact of the escapement wheel teeth on the pallet-stones, wherein each tooth is also able to rest on the next tooth, because of the flexibility provided by the notch, which confers a certain robustness on the wheel in addition to the desired flexibility. The notches must be sufficiently large to grant the whole of each tooth flexibility relative to an attachment area in relation to which the notch allows each tooth a degree of freedom to pivot. This arrangement is not applicable to numerous components, for which pivoting mobility is incompatible with their operational kinematics.

There is also known EP Patent No. 1 870 784 in the name of OMEGA, which discloses a wheel without a felloe but including teeth, and which proposes a solution preventing the teeth from being damaged by shocks. The wheel according to that patent includes flexible bent arms, which bend tangentially and with decreasing width towards the wheel periphery. These arms each include an end tooth, which is also flexible. Although this type of wheel may suit an escapement wheel, like the preceding patent document, the arrangement thereof is less suitable for the particular kinematics linked to certain components such as escapement levers. Moreover, fitting an escapement mechanism with this type of escapement wheel involves replacing the original wheel with this special wheel, without any possibility of re-using the original one.

Various documents propose mechanisms intended to reduce the operational play in the gears, or even to reduce the effect of impact or impulses on some components. Thus there is also known EP Patent Application 1 555 584 A1 in the name of ROLEX SA, which discloses a toothed wheel set, with teeth for taking up play, including slots arranged in the teeth, which are combined with stop means for limiting the amplitude of movement allowed by the slots in accordance with the gear play to be taken up. In a similar manner, JP Patent Application No. 63 130961 in the name of KIYOUIKU HAGURAMA KOGYO KK discloses teeth whose elasticity is provided by slots or chambers. EP Patent Application No. 1 380 772 A1 in the name of WIEDERRECHT discloses a gear of this type. EP Patent Application No. 1 983 389 A1 in the name of ETA SA presents an escapement mechanism wherein a balance roller has slots in proximity to impulse pallets arranged for cooperating with escapement wheels. U.S. Pat. No. 443,363 A in the name of HANSEN discloses an escapement mechanism including resilient damping means. WO Patent Application No. 2010/063393 A1 in the name of ROLLS ROYCE PLC discloses another toothing with teeth made flexible by the presence of slots connected to chambers.

In these embodiments, the travel, inherent in the flexibility of the arms, evaluated at the teeth is on the order of several hundredths or several tenths of a millimeter, which may prove too much in some mechanisms.

SUMMARY OF THE INVENTION

It is an object of the present invention to overcome all or part of the aforementioned drawbacks. In order to overcome the particular problem of escapement lever wear, the object of the invention is to make the contact zone between the escapement lever and the balance elastic, while observing a certain space requirement.

The invention therefore concerns a escapement lever for the escapement mechanism of a timepiece movement, including at least one fork delimiting a notch, which includes horns arranged for cooperating with a balance, characterized in that said fork notch includes, in at least one of said horns, a slot and/or a chamber, for delimiting at least one elastic lip extending between a contact surface and said slot or chamber, said slot or chamber being arranged to confer some elasticity on the corresponding horn, which softens the shock during each impulse by absorbing part of the impact energy and then returning it subsequent to said impact.

According to a feature of the invention, said at least one horn performs an impulse or percussion function during intermittent contacts with at least one contact surface comprised in an end contact zone, and in that said at least one horn has some flexibility due to at least one said slot and/or chamber, made micrometrically in proximity to said at least one contact surface, to delimit at least one elastic lip extending between said contact surface and said at least one slot and/or chamber.

According to a feature of the invention, said at least one elastic lip includes, on one of the external surfaces thereof, at least one said contact surface.

According to a feature of the invention, said at least one elastic lip extends between said contact surface and said at least one slot and/or chamber, and at least another peripheral surface of said horn.

The invention also concerns an escapement mechanism including a escapement lever of this type.

The invention also concerns a timepiece including at least one escapement lever of this type, and/or escapement mechanism of this type.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 1:
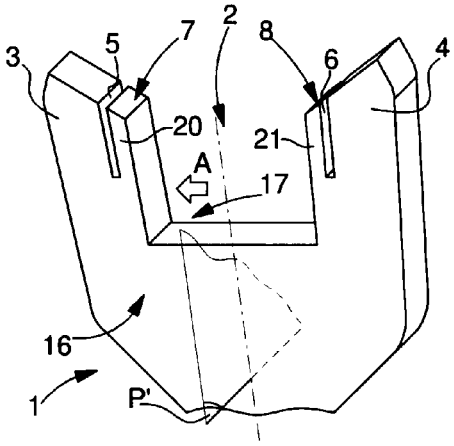
FIG. 1 shows a schematic, partial perspective view of a timepiece escapement lever according to the invention, in a first variant, wherein the escapement lever includes horns provided with slots delimiting elastic lips opening at an inner surface of each horn.

The invention concerns a escapement lever for the escapement mechanism of a timepiece movement, including at least one fork delimiting a notch which includes horns arranged for cooperating with a balance.

It is an object of the invention to perfect a method of improving the resistance to wear and shocks of a timepiece movement component which performs an impulse or percussion function during intermittent contacts on at least one contact surface comprised in an end contact zone, hereinafter referred to as a horn. More specifically, this method is for making a escapement lever for a timepiece movement that is resistant to wear and shocks, or for transforming an existing escapement lever to confer these properties thereon.

The invention is described with more particular reference to the preferred case of an escapement mechanism escapement lever, although this embodiment is not restrictive.

The term "horn" is chosen for the purpose of simplifying the explanation. Although the components to which the invention is preferably applied are salient, they may also include inward surfaces, and the invention applies thereto in the same way.

According to the invention, this end horn is made flexible by the arrangement of at least one micrometric slot or chamber in proximity to the contact surface or surfaces (as appropriate), to delimit at least one elastic lip extending between said contact surface and said at least one slot or chamber, as seen in FIGS. 1, 2, 3, 6 and 7.

According to one feature of the invention, said at least one elastic lip is made to include, on one of the outer surfaces thereof, at least one said contact surface.

This method may be implemented both during fabrication of new components and in order to improve existing components. However, as will be seen in the description below, some embodiments only apply to new fabrication. In particular, this is the case when a micro-machinable material is chosen to make a timepiece component using MEMS technology or the LIGA technique, which is particularly suited for implementing the invention.

The following description will refer to the "making" of components, and it should therefore be understood that this includes both new fabrication and any improvement to a component or movement.

In a particular embodiment of the invention, this slot or chamber is made to delimit the elastic lip between the contact surface, the slot or chamber and at least one other peripheral surface of the horn.

In a preferred, but non-restrictive manner, the lip (and thus the slot or chamber) is made substantially perpendicular, or perpendicular, to a plane in which the component develops, said plane being orthogonal to the contact surface or surfaces (as appropriate).

Preferably, at least one slot, which opens at lateral surfaces comprised in the horn parallel to said plane, is made by wire electro erosion, or by laser, in the case of a escapement lever made in a conventional manner by stamping or suchlike. Or, when a micro-machinable material is chosen for fabricating said component using MEMS technology or the LIGA method, this slot is made during fabrication of the component in accordance with MEMS technology or the LIGA method.

In an embodiment wherein it is chosen to make the horn flexible by forming at least one chamber, said chamber is made in the thickness of the horn, without any access to any of the external surfaces of said horn, during fabrication of said component in micro-machinable material using MEMS technology or the LIGA method. It is also possible to make such chambers with more conventional materials such as steel or alloys, but this involves more expensive multi-layering.

The flexibility given to the horn should not weaken said horn or impair the mechanical resistance thereof. Any irreversible plastic deformation should be avoided. The flexibility must not, in particular, lead to wide amplitude oscillations around an attachment area, which would, sooner or later, result in fatigue in the metalllurgical sense, and a risk of breaking the elastic lip or even the actual horn. It is thus preferable for the width, i.e. the smallest dimension of the slot or chamber, to be very small, so as to give the elastic lip flexibility, but without allowing any movement that would, over time, impair resistance.

Figure 9:
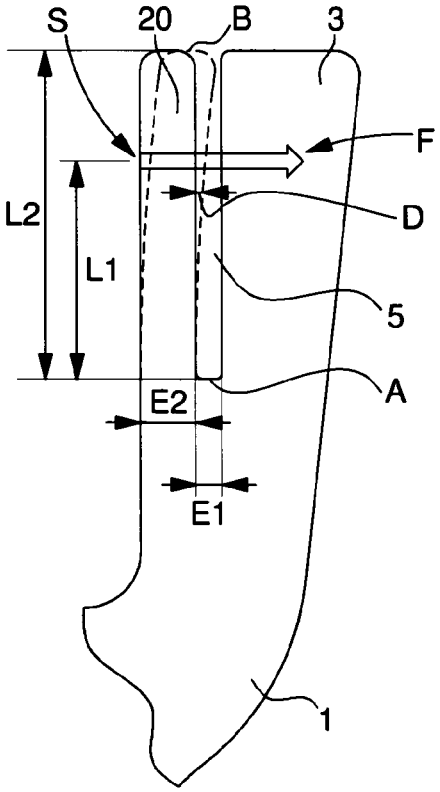
FIG. 9 shows a schematic, partial, front view of a detail of the deformation of an elastic lip made according to the invention.
Figure 10:
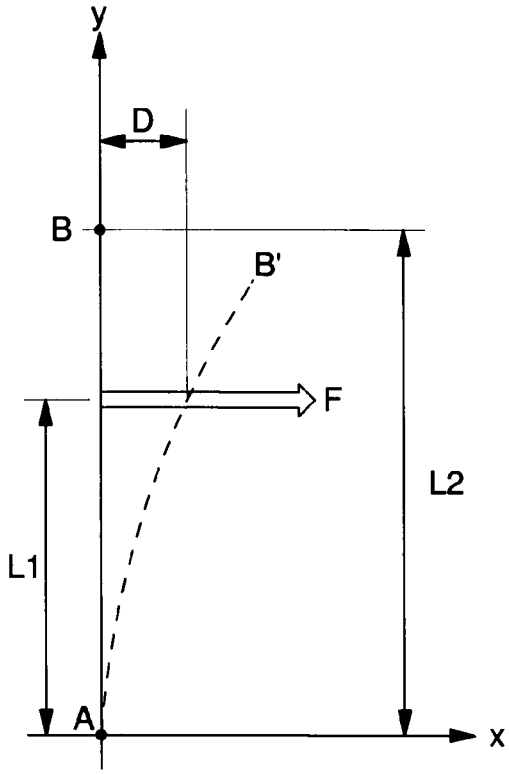
FIG. 10 shows schematically the development of the deformation of this elastic lip.
Figure 19:
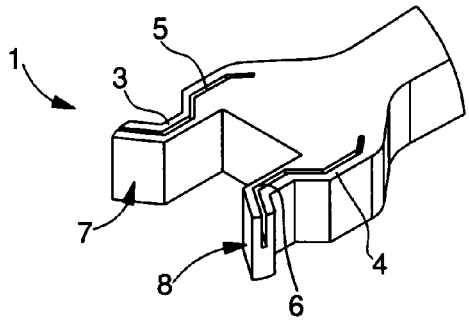

FIGS. 9 and 19 are diagrams of the deformation of an elastic lip 20 arranged in a horn 3 of a escapement lever 1, in proximity to a slot 5. An impact force F is applied to a contact surface S. Surface S is at a distance L1 from the point A where elastic lip 5 is fitted. Said lip has a total length L2. Slot 5 has a width E1 and lip 20 has a thickness E2. The elastic line of elastic lip 5 follows a function D=B(y) which depends on the material and values of F, L2 and E2.

According to the invention, the deformation of lip 20 over the entire length thereof AB, i.e. L2, is made to remain within the elastic domain. The deformation depends upon the material, F, E2 and L1 or L2.

It is also ensured that for the maximum admitted value Fm of F and the maximum value of y, i.e. L2, D is less than E1, i.e. there is no contact between elastic lip 20 and the rest of horn 3.

In an example embodiment of a escapement lever 1 made of steel grade S15P with a limit of elasticity of 210 GPa, and with an impact force F of 80 mN, for the dimensions E1=15 μm, E2=30 μm, and L2=150 μm, a maximum value of D equal=2 μm is obtained and a stress level of less than 800 MPa.

Preferably, the smallest dimension of the elastic lip is limited, in order to provide sufficient flexibility.

In short, the deformations of the elastic lip remain within the elastic domain of the material of which it is formed. Width E2 is an important parameter in the sizing of the lip, since it must be ensured that the combination of impact force F and the dimensions of the elastic lip cause deformations that are within the elastic domain thereof.

Preferably, width E2 of the elastic lip is less than a quarter of its length L2, and, preferably, less than an eighth of L2. In a preferred application, this width E2 is also less than or equal to 30 μm.

The smallest dimension of slot E1 must be just large enough to prevent any contact between point B of the lip and the other part of horn 3.

Advantageously, this slot or chamber is made with a smallest dimension of several micrometers, in a ratio of less than one eighth relative to its development in length.

Preferably, the smallest dimension of the elastic lip is also limited to provide sufficient flexibility.

The invention also applies particularly well to the components of an escapement mechanism, which are those most frequently stressed by stresses linked to impulses and shocks.

More specifically, the application of the invention to a escapement lever is particularly advantageous, and will be described hereinafter more specifically for this non-limiting application of the invention.

The invention thus concerns a escapement lever 1 for the escapement mechanism of a timepiece movement, including at least one fork delimiting a fork notch 2. This fork notch 2 includes horns 3 and 4 arranged to cooperate, at contact surfaces S, with a balance, which is not shown in the Figures, in general with an impulse pin comprised in the balance.

According to the invention, fork notch 2 includes, in at least one horn 3, 4, and preferably in each horn 3, 4, at least one slot, respectively 5, 6 or/and at least one chamber 30 for delimiting at least one elastic lip 20, 21, extending between a contact surface S, and this slot 5, 6 or chamber 30.

Each slot 5, 6 or chamber 30 is arranged to confer elasticity on the corresponding horn, which softens the shock at each impulse, by absorbing part of the impact energy, and then returning it subsequent to said impact. Thus the slot or chamber makes the contact area elastic. The function of the slot or chamber is to reduce wear by softening the contacts between impulse pin of the balance and the escapement lever fork during the release and impulse phases.

This at least one horn 3, 4 performs an impulse or percussion function during intermittent contacts on at least one contact surface comprised in an end contact area, and this at least one horn 3, 4 is flexible due to at least one such slot 5, 6 or/and chamber 30, made micrometrically in proximity to said at least one contact surface, to delimit at least one elastic lip 20, 21, extending between said contact surface and said at least one slot 5, 6 or/and chamber 30.

Another object achieved by the invention is to reduce the phenomenon of sticking in the escapement cycle.

Preferably, this at least one elastic lip 20, 21 includes, on one of the external contact surfaces thereof, at least one such contact surface.

In a variant of the invention, this at least one elastic lip 20, 21 extends between the contact surface and said at least one slot 5, 6 or/and chamber 30, and at least one other peripheral surface of horn 3, 4.

Each slot or chamber has a straight or any other profile. A "chamber" means a volume enclosed in the material with no opening, and a "slot" means a space opening at least one of the external surfaces of the components concerned.

The width of each slot is preferably several micrometers, and it is always very small relative to the development of the slot in length, preferably in a ratio of less than one eighth.

Preferably, each slot extends in at least one oblique or perpendicular direction relative to a plane P in which fork notch 2 or even the entire escapement lever 1 develops, as is generally the case. This at least one slot 5, 6 or/and chamber 30 is substantially perpendicular to a plane P in which escapement lever 1 develops, said plane P being orthogonal to the contact surface or contact surfaces.

Preferably, and economically, each slot extends perpendicular to said plane P.

Thus, it is particularly easy to make escapement lever 1 using MEMS technology or the LIGA process or suchlike. For other methods of making escapement lever 1, particularly from a metal, plastic, polymer or other type of sheet, it is preferable to fabricate a slot perpendicular to plane P, since said slot can be made by wire electro erosion, wire cutting, laser, plastic injection or a similar method.

Escapement lever 1 may also be made of a more conventional material: unhardened "S15P" grade iron steel, iron free steel "Ck75", aluminium alloy, or another metal or alloy. The treatment for fabricating the plate from which the escapement lever is extracted is of particular importance and it is well known to those skilled in the art. As regards plastic materials, a polymer such as polyoxymethylene POM "Hostaform" may be used.

A component according to the invention may be made by laser technology in this type of material, with a through etch, by wire electro erosion, water jet cutting or suchlike.

In a preferred embodiment, each slot opens at the peripheral contour of fork notch 2, i.e. as appropriate, towards the interior of the horns, i.e. on the side of the impulse pin of the balance roller, on an inner surface, respectively 7, 8, or towards the exterior of the horns, i.e. on the side opposite the impulse pin, on an external surface, respectively 9, 10.

A first variant is shown in FIG. 1. The fork notch 2 includes, in at least one horn, and preferably in each horn, a slot 5, 6 which extends perpendicularly to the plane of the escapement lever, and opens towards the interior of the horns, i.e. fork notch 2 on the side of the impulse pin of the balance roller, on an inner surface 7, 8, delimiting at least one elastic lip 20, 21, extending between this inner surface 7, 8 and said slot 5, 6.

Figure 2:
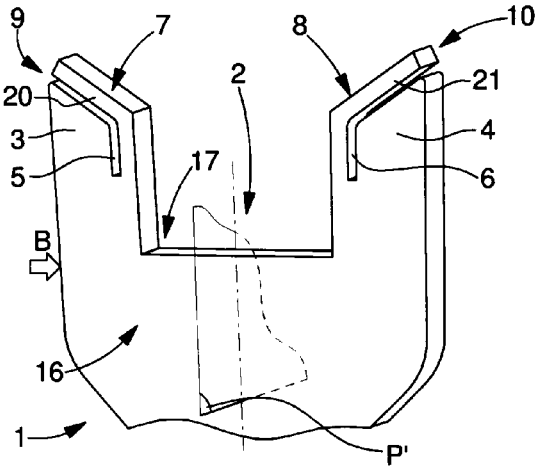
FIG. 2 shows a schematic, partial, perspective view of a timepiece escapement lever to which the method of the invention has been applied, in a second variant wherein the escapement lever includes horns provided with slots delimiting elastic lips opening at an external surface of each horn.

A second variant is shown in FIG. 2. The fork notch includes, in at least one horn, and preferably in each horn, a slot which extends perpendicularly to the plane of the escapement lever, and opens towards the exterior, i.e. on the opposite side to the impulse pin of the balance roller. Slot 5, 6 opens at the peripheral contour of fork notch 2 towards the exterior of the horns, on an external surface 9, 10, delimiting at least one elastic lip 20, 21 extending between said external surface 9, 10 and said slot 5, 6. This arrangement also reduces the intensity of impacts with the overbanking pins.

A particular advantage of this arrangement is that it limits any over-stresses, in the event of shock between the impulse-pin and the top of the horn, as well as limiting the risk of breakage, for example of breaking the balance pivot.

In a variant of the invention, this at least one slot 5, 6 or/and chamber 30 opens at lateral surfaces comprised in the horn 3, 4 parallel to a plane P in which escapement lever 1 develops, said plane P being orthogonal to the contact surface or contact surfaces.

Figure 3:
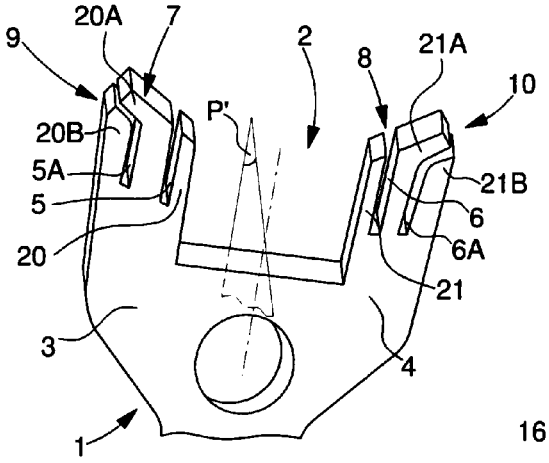
FIG. 3 shows a schematic, partial, perspective view of a timepiece escapement lever to which the method of the invention has been applied, in a third variant, wherein the escapement lever includes horns provided with slots delimiting elastic lips opening at an inner surface of each horn, and slots delimiting elastic lips opening at an outer surface of each horn.
Figure 4:
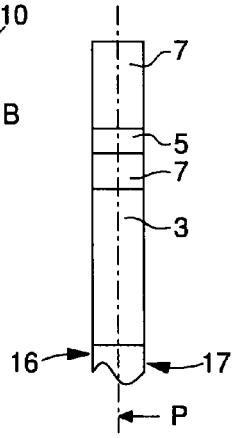
FIG. 4 shows a schematic, partial, cross-section along a median fork notch plane, the escapement lever of FIG. 1, seen in a direction A.
Figure 5:
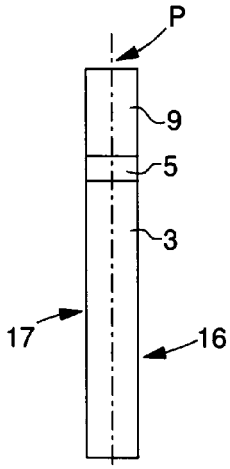
FIG. 5 shows a schematic, partial, end view of the escapement lever of FIG. 2 seen in a direction B.

A third variant, seen in FIG. 3, combines the embodiments of the first embodiment and second embodiment, with a slot in each horn opening at an inner end surface and a slot opening at an external end surface. Each horn 3, 4 includes a slot 5, 6 opening at an inner surface 7, 8 and a slot 5A, 6A opening at an external surface 9, 10 delimiting a plurality of elastic lips 20, 20A, 20B, 21, 21A, 21B, extending between the periphery of horn 3, 4, the inner surface 7, 8, the outer surface 9, 10 and slots 5, 5A, 6, 6A.

In a variant, at least one slot 5, 6 opens at the peripheral contour of fork notch 2 towards the exterior of horns 3, 4 on an external surface 9, 10 delimiting at least one said elastic lip 20, 21 extending between said external surface 9, 10 and said one slot 5, 6.

In a variant, at least one slot 5, 6 opens at the peripheral contour of fork notch 2 towards the interior of horns 3, 4 on an inner surface 7, 8 delimiting at least one elastic lip 20, 21 extending between said inner surface 7, 8 and said slot 5, 6.

In another variant, each horn 3, 4 includes a slot 5, 6 opening at an inner surface 7, 8 and a slot 5A, 6A opening at an external surface 9, 10 delimiting a plurality of elastic lips 20, 20A, 20B, 21, 21A, 21B extending between the periphery of the horn 3, 4, said inner surface 7, 8, said external surface 9, 10 and said slots 5, 5A, 6, 6A.

Figure 6:
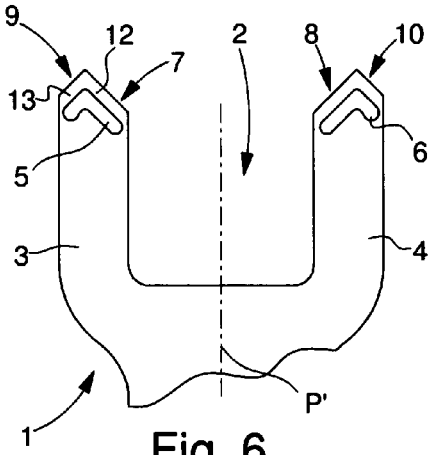
FIG. 6 shows a schematic, partial, front view of a timepiece escapement lever to which the method of the invention has been applied, in a fourth variant, wherein the escapement lever includes horns, each provided with a slot delimiting a flexible zone, and not opening at an inner or outer surface of each horn, but only at lateral surfaces of said horns.

A fourth embodiment is shown in FIG. 6 in which the elastic slot 5, 6 does not open at an inner end surface 7, 8 or outer end surface 9, 10, but only at least one of lateral faces 16, 17 comprised in escapement lever 1, parallel to the plane P thereof. Preferably, for the symmetry of the internal stresses, the slot opens at the two opposite lateral faces.

Figure 7:
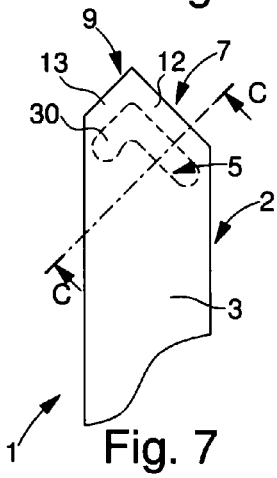
FIG. 7 shows a schematic, partial, front view of a timepiece escapement lever to which the method according to the invention has been applied, in a fifth variant wherein said escapement lever includes a chamber that does not open out, delimiting a flexible zone.
Figure 8:
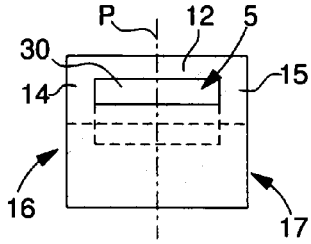
FIG. 8 shows a schematic, partial cross-section of the escapement lever of FIG. 7 along a plane CC perpendicular to the plane of the fork.

A fifth variant is shown in FIGS. 7 and 8. It includes at least one chamber 30 inside one horn. This chamber 30 does not have an opening, and it is housed entirely within the thickness of the horn 3, 4, with no access to any of the external surfaces thereof. This chamber 30 is preferably delimited, on the side of inner end surface 7 and external end surface 9, by external areas which are elastic lips of small section 12, 13, such that the end of the horn has elastic behaviour. Preferably and for the same purpose, chamber 30 is also delimited by a lateral area of small section 14, 15, on the side of each of the lateral surfaces 16, 17 of escapement lever 1, comprised therein parallel to plane P thereof.

Advantageously, the arrangement of a flexible escapement lever fork notch area according to the invention significantly reduces any impact pressures.

Figure 11:
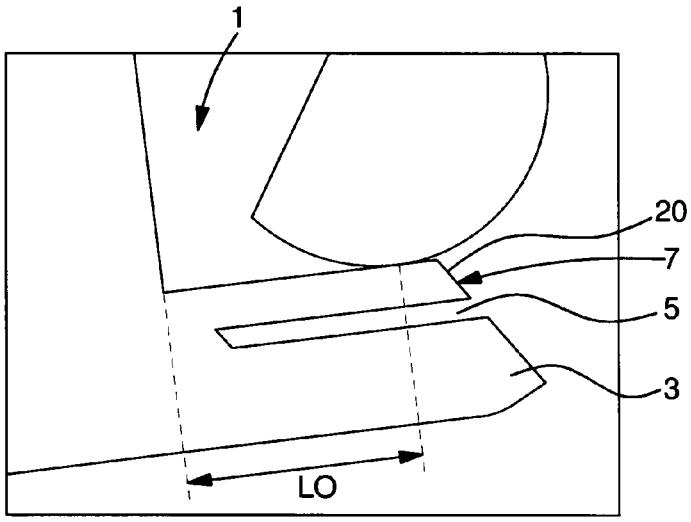
FIG. 11 shows schematically a detail of the cooperation between a flexible fork notch of a escapement lever according to the invention, in the example embodiment of FIG. 1, with an impulse pin of a balance roller.

FIG. 11 shows schematically a detail of the cooperation between a flexible fork notch of escapement lever 1 according to the invention, in the example embodiment of FIG. 1, and a impulse-pin of a balance roller. The length LO is the distance between the bottom of slot 5 and the point of contact of the impulse-pin, and corresponds to the length of a beam formed by the elastic lip 20 fitted in the bottom of slot 5. In two example embodiments where the proportions are approximately 10/8/2/1 and 15/8/2/1 respectively between length LO, the total width of the escapement lever, the width of the elastic lip, the width of the slot, the hertz pressure at the point of impact, namely at the distance LO from the bottom of the slot, is reduced compared to conventional escapement levers made of the same material but without any slot or chamber, by a respective value of 32% in the first case, and 38% in the second case.

Figure 12:
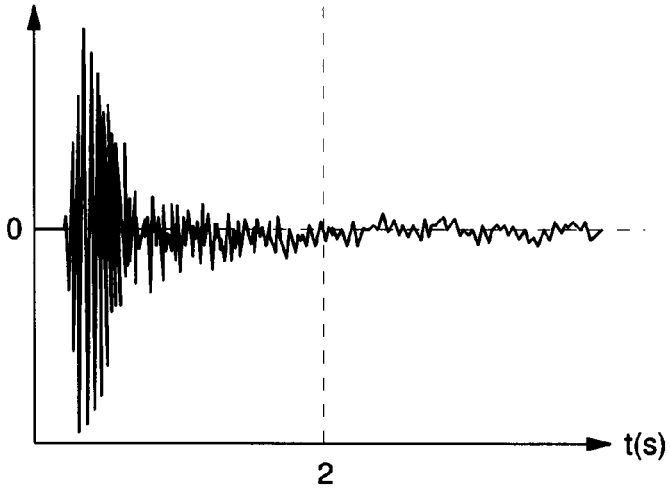
FIG. 12 is a diagram illustrating the clearance, as a function of time, of the end of the escapement lever horn of FIG. 11, in response to a given impact.
Figure 13:
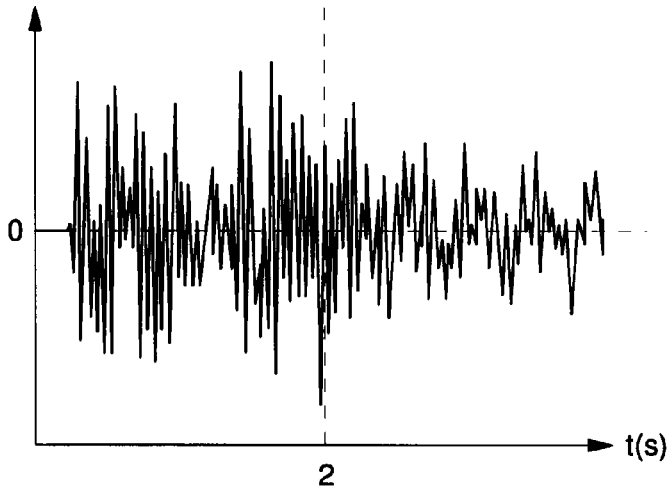
FIG. 13 is a comparative diagram, in the same conditions, of a conventional escapement lever with a solid horn and without the elastic lip or chamber made according to the invention.

FIGS. 12 and 13 illustrate the difference in stabilisation of the escapement lever, between the escapement lever of FIG. 11 according to the invention for the diagram of FIG. 12 and a solid escapement lever for the diagram of FIG. 12, both illustrating the clearance, over time, of the end of the escapement lever horn in response to a given impact. Stabilisation occurs, for the escapement lever according to the invention, in approximately a quarter of the time of the conventional escapement lever.

Figure 14:
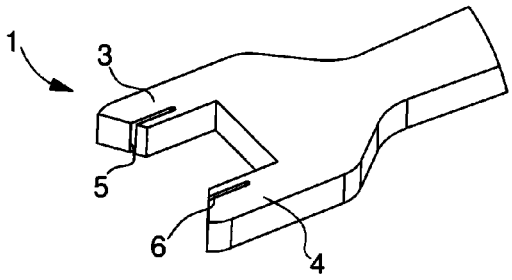
FIGS. 14 to 23 illustrate schematically and in perspective, various escapement lever configurations according to the invention.
Figure 15:
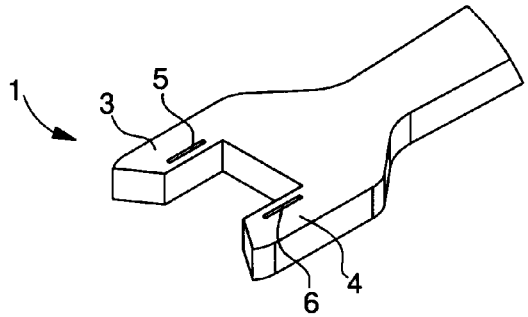
Figure 16:
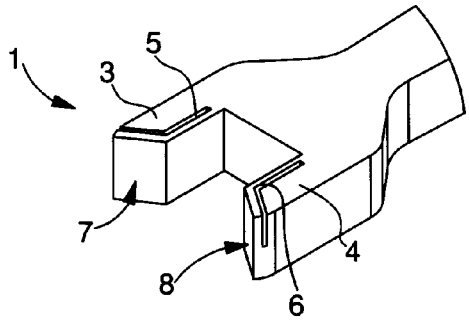
Figure 17:
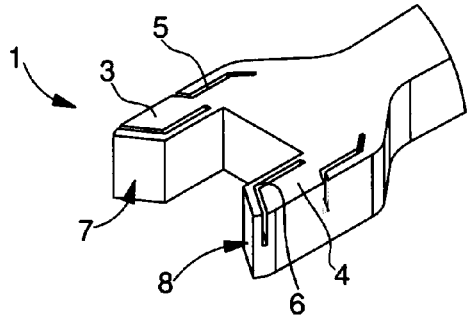
Figure 18:
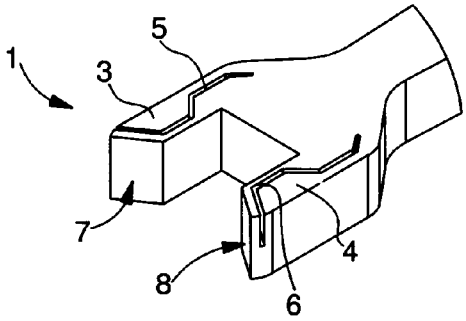
Figure 20:
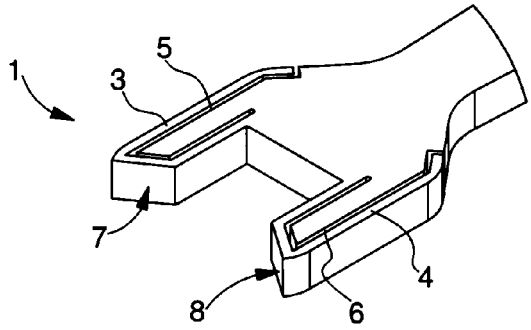
Figure 21:
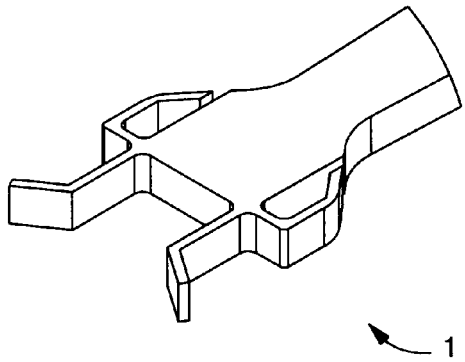
Figure 22:
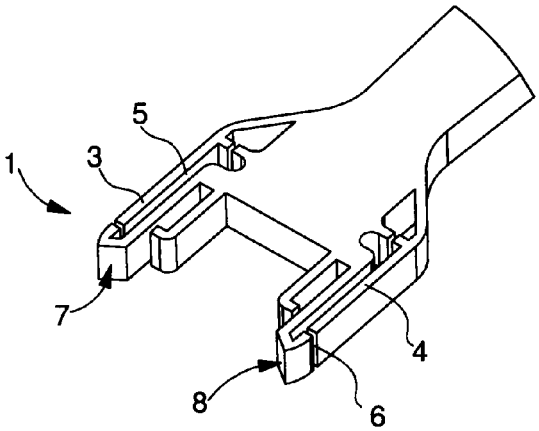
Figure 23:
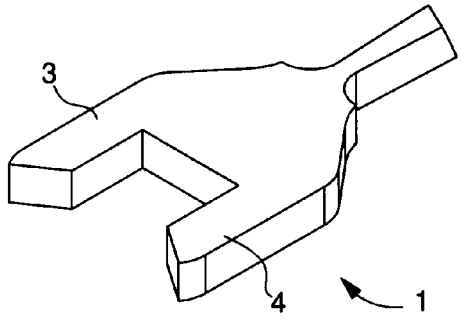

FIGS. 14 to 23 illustrate, in a non-limiting manner various configurations of escapement levers according to the invention, and for dedicated applications:

FIG. 14: unlocking and impulse,
FIG. 15: unlocking and impulse,
FIG. 16: unlocking and impulse, shocks,
FIG. 17: unlocking and impulse, shocks, detent-pins,
FIG. 18: unlocking and impulse, shocks, detent-pins,
FIG. 19: unlocking and impulse, shocks, detent-pins, limiting of mass being driven,
FIG. 20: unlocking and impulse, shocks, detent-pins,
FIG. 21: unlocking and impulse, shocks, detent-pins,
FIG. 22: unlocking and impulse, shocks, detent-pins and safety mechanisms,
FIG. 23: unlocking and impulse, shocks, detent-pins, It is also possible to equip the two horns of the same escapement lever differently.

Thus, it is possible and particularly easy to make escapement lever 1, in particular according to the fifth embodiment, in a micromachinable material using MEMS technology or the LIGA process or suchlike. Preferably, escapement lever 1 is made in a micro-machinable material using the LIGA method.

Thus, the choice of this micro-machinable material allows very fine slots or chambers to be made accurately, with no concerns as to the existence of a local defect in material, a pre-fissure, or even local internal over-stresses, which are more frequently encountered with a more conventional steel or alloy. The very small size of the smallest dimensions of the slot or chamber limits the vibration amplitude of the elastic lips, prevents any non-reversible deformation and avoids any breakage of the lips.

It is naturally possible to make a component with elastic lips according to the invention in another material, steel or alloy, advantageously with a layer deposited on the surface of said component, or even using a heat or/and surface treatment of the component.

In a variant, the slot or chamber is not filled with air or vacuum, but with another material with different characteristics from the basic material, for example an adhesive or a treatment or a thick, flexible surface coating of around 5 to 10 microns. This other material may have particular elastic characteristics, which can enable a particular elastic behaviour to be adapted, contributing to the damping and anti-wear action. The fact of having a solid component prevents waste from the wear of the timepiece movement accumulating in the slots, which is also the advantage of fabrication using a chamber without any opening.

Likewise, it is possible to insert a deformable plastic in the slot or chamber.

It is clear that the Figures only show one slot or one chamber in each embodiment, but it is naturally possible to juxtapose a plurality of slots and/or chambers and to combine the various non-limiting embodiments of the invention set out above.

For example, a plurality of substantially parallel slots or chambers in chevron form, even if they are of very small size, and notably with low development in their largest dimension, gives the horn sufficient flexibility.

The entire escapement lever horn is thus made flexible by at least one such slot or chamber, to decrease wear, making the contact area with the balance elastic.

Naturally, everything that applies to one horn applies to the other, preferably symmetrically relative to a median plane P' orthogonal to plane P.

One particular embodiment is made with a escapement lever 1 made of silicon or a silicon compound.

The invention also concerns an escapement mechanism including at least one escapement lever of this type.

The invention also concerns a timepiece including at least one such escapement lever, and/or escapement mechanism and/or at least one component made or improved in accordance with this method.

Of course, this invention is not limited to the illustrated example but is capable of various variants and alterations that will appear to those skilled in the art.

The invention claimed is:

1. A set for an escapement mechanism of a timepiece movement, comprising:

a balance including an impulse pin of a balance roller; and an escapement lever including at least one fork having horns delimiting a fork notch, said horns being arranged to cooperate with said impulse pin of said balance, and at least one of said horns has a slot or a chamber to delimit at least one elastic lip extending between a contact surface and said slot or said chamber, wherein said slot or said chamber is arranged to confer elasticity on a corresponding horn of said at least one of said horns to soften shock during each impulse from said impulse pin by absorbing part of an impact energy and then returning said energy subsequent to said impulse.

2. The set for an escapement mechanism according to claim 1, wherein said at least one of said horns performs an impulse or percussion function during intermittent contacts on said contact surface including an end contact area, and wherein said at least one of said horns is flexible due to said slot or said chamber, said slot or said chamber being made micrometrically in proximity to said contact surface.

3. The set for an escapement mechanism according to claim 2, said wherein said at least one elastic lip includes said contact surface.

4. The set for an escapement mechanism according to claim 2, wherein said at least one elastic lip extends between said contact surface, said slot or said chamber, and at least one other peripheral surface of said at least one of said horns.

5. The set for an escapement mechanism according to claim 2, wherein said slot or said chamber is substantially perpendicular to a plane of said escapement lever, said plane being orthogonal to said contact surface.

6. The set for an escapement mechanism according to claim 2, wherein said slot or said chamber opens at lateral surfaces of said at least one of said horns parallel to a plane of said escapement lever, said plane being orthogonal to said contact surface.

7. The set for an escapement mechanism according to claim 2, wherein a width of said at least one elastic lip is less than a quarter of a length of said at least one elastic lip, and wherein said width of said at least one elastic lip is less than or equal to 30 μm.

8. The set for an escapement mechanism according to claim 1, wherein said slot opens at a peripheral contour of said fork notch towards an exterior of said horns on an external surface and delimits said at least one elastic lip extending between an external surface and said slot.

9. The set for an escapement mechanism according to claim 1, wherein said slot opens at a peripheral contour of said fork notch towards an interior of said horns on an inner surface and delimits said at least one elastic lip (20; 21) extending between an inner surface and said slot.

10. The set for an escapement mechanism according to claim 1, wherein each of said horns includes a slot opening at an inner surface and a slot opening at an external surface delimiting a plurality of elastic lips extending between the periphery of said horns, a respective inner surface, a respective external surface, and respective slots.

11. The set for an escapement mechanism according to claim 1, wherein said at least one of said horns has said slot, said slot being open only at least one lateral face of said escapement lever, said at least one lateral face being parallel to a plane of said escapement lever and being orthogonal to said contact surface.

12. The set for an escapement mechanism according to claim 1, wherein said at least one of said horns has said chamber, said chamber being provided with no access to any external surfaces of said escapement lever.

13. The set for an escapement mechanism according to claim 1, wherein said at least one of said horns has said chamber, said chamber being disposed inside said at least one of said horns and is delimited on an inner surface side and an outer surface side by elastic lips of small section, such that an end of said at least one of said horns has elastic behaviour, and wherein said chamber is further delimited, on lateral face sides of said escapement lever, the lateral face sides being parallel to a plane of said escapement lever, by a lateral zone of said small section.

14. The set for an escapement mechanism according to claim 1, wherein said escapement lever is made in a micromachinable material using an LIGA method.

15. A timepiece including at least one set for an escapement mechanism according to claim 1.

16. The set for an escapement mechanism according to claim 1, wherein said slot or said chamber has a width of several micrometers, and wherein a ratio of said width to a length of said slot or said chamber is less than one to eight.

17. The set for an escapement mechanism according to claim 1, wherein said at least one elastic lip has a total length of 150 μm and a thickness of 30 μm, wherein said slot has a width of 15 μm, and wherein said escapement lever is made of steel grade S15P with a limit of elasticity of 210 GPa.

18. The set for an escapement mechanism according to claim 1, wherein a contact length of said slot is a distance between a bottom of said slot and a point of contact of said impulse pin, and wherein a ratio between said contact length, a total width of said escapement lever, a width of said at least one elastic lip, and a width of said slot is 10 to 8 to 2 to 1.

19. The set for an escapement mechanism according to claim 1, wherein a contact length of said slot is a distance between a bottom of said slot and a point of contact of said impulse pin, and wherein a ratio between said contact length, a total width of said escapement lever, a width of said at least one elastic lip, and a width of said slot is 15 to 8 to 2 to 1.

20. The set for an escapement mechanism according to claim 1, wherein said slot or said chamber is filled with another material having different characteristics from a material of said escapement lever, said another material having elastic characteristics contributing to damping and anti-wear action.

21. An escapement mechanism including at least one set for an escapement mechanism according to claim 1.

22. The escapement mechanism according to claim 15, further comprising detent-pins, wherein said slots are arranged to cooperate with said detent-pins.

23. Escapement mechanism according to claim 22, wherein said slots are arranged to cooperate with said detent-pins and are each continuous between the end of respective said horn and the point of contact of said detent-pin.

* * * * *